US005836024A

United States Patent [19]

Uglehus et al.

[11] Patent Number: 5,836,024

[45] Date of Patent: Nov. 17, 1998

[54] SUPPORT DEVICE

[75] Inventors: Janet Uglehus, 68 Achille Rd., Grimsby DN34 5RB; Russell Birchall, Liverpool; Christopher Hawes, Cheshire, all of United Kingdom

[73] Assignee: Janet Uglehus, Grimsby, United Kingdom

[21] Appl. No.: 788,853

[22] Filed: Jan. 23, 1997

[30] Foreign Application Priority Data

Jan. 24, 1996 [GB] United Kingdom ..... 9601380

[51] Int. Cl.[6] ..... A47G 9/00

[52] U.S. Cl. ..... 5/636; 5/646; 5/630; 2/170; 2/171; 2/DIG. 11

[58] Field of Search ..... 5/636, 637, 640, 5/644, 645, 646, 647, 648, 650, 630, 632; 2/171, 170, DIG. 11

[56] References Cited

U.S. PATENT DOCUMENTS

| | | | |
|---|---|---|---|
| 1,431,110 | 10/1922 | Fromhart | 5/636 |
| 1,491,146 | 4/1924 | Larson | 5/636 |
| 3,848,281 | 11/1974 | Mathews . | |
| 4,185,331 | 1/1980 | Nomiyama | 2/411 |
| 4,613,993 | 9/1986 | Steele et al. | 2/411 |
| 4,646,367 | 3/1987 | El Hassen | 2/411 |
| 5,007,122 | 4/1991 | Daughdrill | 5/637 |
| 5,075,903 | 12/1991 | Richoux | 2/411 |
| 5,129,106 | 7/1992 | Liou | 2/411 |
| 5,418,991 | 5/1995 | Shiflett | 5/650 |

FOREIGN PATENT DOCUMENTS

| | | | |
|---|---|---|---|
| 200817 | 7/1923 | United Kingdom . | |
| 275485 | 8/1927 | United Kingdom . | |
| 1510415 | 5/1978 | United Kingdom . | |
| 2198341 | 12/1986 | United Kingdom . | |
| 2269741 | 7/1992 | United Kingdom | 5/655 |

OTHER PUBLICATIONS

Undated, Henleys Medical Supplies Limited product information brochure.

Mar./Apr. 1997, Adams, James reference, *Engineering First.*

*Primary Examiner*—Alexander Grosz

*Attorney, Agent, or Firm*—Miller, Sisson, Chapman & Nash, PC

[57] ABSTRACT

A support device comprising, a ring having inner and outer surfaces which, when fitted around a part of the body, lifts that part of the body clear of the surface on which the outer surface of the ring rests, and which permits the said part of the body to move. In a preferred embodiment the support device is U-shaped, is adapted to elevate the head of a user, and is removably attachable to the head of the user with the aid of a slider strap.

19 Claims, 7 Drawing Sheets

SUPPORT DEVICE

FIELD OF THE INVENTION

This invention relates to a device which supports a part of the body.

BACKGROUND OF THE INVENTION

Many people wish to avoid the on set of the ageing process, which results in the skin becomming lined. In an attempt to mitigate the effects of ageing on the skin some people apply creams, some adopt particular diets, others have cosmetic surgery.

One aspect of this invention is particularly concerned with people who have had face-lifts. The term face-lifts emcompasses partial face-lifts, such as lower face-lifts, eye-lifts, upper and lower eye bag removal, as well as complete face-lifts.

A face-lift operation involves the removal of a portion of skin, followed by the stretching of the remaining skin over the portion which has been removed. The stretched skin is then stitched, or otherwise re-joined together. The portion of skin is usually removed from the neck, rising up behind the ear.

For a considerable time after a face-lift operation, the patient is in considerable pain. This is particularly so prior to the removal of the stitches (or other fastening means), but pain is also felt by many for a number of months after the stitches have been removed.

A problem found by many people who have had face-lifts is that sleeping causes great discomfort. This is because lying down causes the stitched or scarred areas to be stretched, thus causing pain. Using pillows does not provide a satisfactory solution to the problem, since the pillow usually touches the stitched or scarred areas. When lying down with no pillow, the head is not in the same position, with respect to the rest of the body, as when standing upright. It is when standing upright that the stretching forces (due to the stretched skin) on the stitching or scar tissue, are balanced. Any movement away from that position changes the stretching forces on the stitching or scar tissue and causes pain.

In GB 1 510 415, and GB 2 198 341 inflatable cushions which fit around the neck of the wearer are disclosed. However, those cushions are designed to utilize the shape of the head, neck and shoulders to keep them around the neck. Such devices would interfere with the stitched or scarred are of a person who has had a face-lift, and would not support other parts of the body effectively.

In U.S. Pat. No. 5,007,122, and U.S. Pat No. 5,418,991 devices for immobilizing parts of the body are disclosed.

It is therefore, an object of the invention to provide a support which, when lying down supports the head, with respect to the rest of the body, in essentially same the position that the head would be in when standing upright. In such a case a pillow is not required.

In another aspect of this invention there is provided a device to delay the onset of ageing. Wrinkling of the skin can be caused by lying on a pillow with a part of the face touching the pillow. When the face touches the pillow, the face's skin is stretched. This stretching can cause lines to develop. It is therefore desirable to provide a device which enables a person to lie down without his or her face touching the pillow. This could be achieved by the person lying on his or her back. However, for many people lying down on the back is not comfortable.

The problem is solved by the provision of a support according to the invention, which is worn on the head, whilst lying down (sleeping or other-wise). The need for a pillow is overcome, or if used the head is raised off the surface of the pillow. The wearer lies on his or her side or back, without his or her face touching the surface on which he or she lies.

In another aspect of the invention, a support device is provided which has uses particularly in the medical field where it is desirable to lift a part of the body off the surface on which it would normally lie. This is particularly so with people who have suffered burns, or other skin problems, such as bed sores, which are irritated, or cause pain simply because the skin is touching a surface, for example, when lying on a bed. At present limbs are held off surfaces by placing the limb in a sling, and suspending the sling from an object, such as an overhead member. This limits the person's movement and effectively tethers him or her to the object from which the sling is suspended. Such a device would also prove useful for ambulance crews and paramedics, since it would enable a part of an accident victim's body, e.g the head, to be supported in a comfortable position rather than the head simply resting on a hard surface such as a road.

It would therefore be desirable to provide a support which enables a limb (or other part of the body) to be lifted off a surface, but which does not restrict the movement of the person.

People suffering from diseases such as Parkinson's disease and Huntington's disease often injure themselves because the diseases they suffer are nervous disorders which can cause involuntary movements. It would therefore be desirable to provide a device which, when fitted to a person suffering from one of the diseases mentioned, would reduce the risk of injury to the person.

SUMMARY OF THE INVENTION

The invention provides a support device comprising, a ring having inner and outer surfaces which when fitted around a part of the body, lifts that part of the body clear of the surface on which the outer surface of the ring rests, and which permits the said part of the body to move.

Preferably, the dimensions of the ring and/or the material from which the said ring is made are adapted to the size and weight of the part of the body to which the said ring is to be fitted. Even more preferably, the invention provides for the ring to be adaptable to the size and weight of the part of the body to which the said ring is to be fitted.

The size of the ring may be adjustable.

At least a part of the ring may comprise a resilient portion which may be a foam type material, or may be an inflatable tube. In a preferred embodiment, the whole of the ring is made from a resilient foam material. The ring may comprise a portion of resilient material, which forms the support for the body, and a connecting means, such as a strap, which joins the two ends of the portion of resilient material. Such a strap may provide for adjustment, so that the ring can be used on different parts of the body, or on different people. The resilient material may be U shaped, the free ends of the U being joined by a strap, which may itself be made from a resilient material.

Advantageously, at least a part of the ring is covered with a layer of material, and preferably the or each resilient portion of the ring is covered with the layer of material. More preferably, the covering material is washable and capable of being sterilized. Even more preferably, the material is waterproof.

The ring may be essentially circular in cross-section. Where it is desired to limit the extent to which the supported part of the body can move, at least one portion of the ring may be flat.

Additional means to assist in securing the support to the body may be provided. In the case of a ring to support a person's head, such additional means may comprise a securing strap which is joined to opposite sides of the ring, and which passes over the top of the head when the ring is fitted to a person's head. The securing strap may be adjustable in length, and adjustment may be provided by telescopically mounting the securing strap on the ring, or providing one end of the strap which a buckle, and the other end with holes. Preferably, the position of the securing strap on the ring may be varied. To this end, the securing strap may be mounted so as to enable it to slide with respect to the ring. The mounting which provides for sliding may slide along the inside or the outside of the ring.

In preferred embodiment of the invention there is provided a support, comprising a ring so shaped and dimensioned that when fitted to a person's head, and the person is lying down, the head is supported and maintained with respect to the rest of the person's body, in essentially the same position that the head would be in if the person were standing upright.

In one embodiment of the invention the support device comprises inner and outer rings moveable with respect to each other, the inner ring comprising at least one resilient or inflatable member, and preferably a plurality of discrete resilient or inflatable members. The outer ring is preferably made from a relatively hard material, such as a plastics material, the inner ring being rotatably mounted on the outer ring by a mounting means. The mounting means may comprise a plurality of rollers. Advantageously, the inner ring comprises a shell formed from a relatively hard plastics material, there being at least one resilient or inflatable member mounted within the said shell. The shell may provide a groove in which the outer ring may sit. Alternatively, the outer ring may be provided with a groove, and the inner ring with a protrusion which co-operates with the said groove to provide for rotation. The groove and/or the outer ring may be provided with a friction reducing material, such as Teflon ®, to provide for relative movement of the inner and outer rings. Advantageously, the or each resilient member is sufficiently resilient to provide for the device to fit securely on to heads of differing size. Where at least one inflatable member is provided, inflating the or each member by a differing amount allows the device to fit securely on to heads of differing size.

The invention also provides a method of supporting and maintaining a part of the body above a surface by fitting to the said part of the body a support device according to the invention which, when fitted around a part of the body, lifts that part of the body clear of the surface on which the outer surface of the ring rests. And preferably, the method provides for supporting and maintaining a person's head, with respect to the rest of the person's body, in essentially the same position that the head would be in if the person were standing upright.

In a preferred embodiment, a method of alleviating discomfort, caused by burns or other skin conditions, is provided by fitting at least two support devices according to the invention to a part of the body, such as a limb, where the burnt area or skin condition is present, one ring being fitted to the part of the body on either side of the affected area of skin. Where there is more than one area of skin on a part of the body with a skin condition present, there may be provided a more than two supports according to the invention, the method providing for the fitting of the said support devices on either side of an affected area.

The support device of the invention fits securely on to the desired part of the body, yet still allows that part of the body to move. The device has uses in many fields, for instance as a device to defer the onset of ageing, as a device which assists in preventing people suffering from nervous disorders from hurting themselves, and as device to decrease the pain suffered by people who have had face-lifts or have other skin problems. Also, the device would be useful for ambulance and paramedic crews, and could form part of a basic first aid kit. The simplicity of the device makes it relatively cheap to manufacture, and allows it to be used for a number of different purposes.

BRIEF DESCRIPTION OF THE DRAWINGS

In the drawings, which illustrate exemplary embodiments of the support device of the invention.

DETAILED DESCRIPTION OF THE ILLUSTRATED EMBODIMENT

The support, shown generally at 1, comprises a cylindrical ring. The support device 1 is fitted around the part of the body which is to be supported, such as the head, so that the void 2 is filled.

The diameter of the void 2 is adapted to the size of the part of the body which is to be supported. When the support device 1 is fitted, the support device is deformed, and the diameter of void 2 is increased. This ensures that the support 1 fits securely to the part of the body to be supported.

The support device 1 is fabricated from a resilient material, such as foam.

The support device 1 may be covered with a layer of material (not shown). The characteristics of the material forming the covering layer may be adapted for the particular use to which the support device 1 is to be put. Where the support device 1 is to be used in an effort to prevent ageing, the covering material would be a fabric chosen for its characteristics relating to comfort and washability. Where the support device 1 is to be used in hospitals the covering material would need to be sterilizable, and may need to be water proof.

In use, for example when a person wishes to sleep without a pillow, the support device 1 is pulled onto the head so that the head fills void 2. When the person lies down, the head is maintained in a position above the surface on which the said person lies by the support device 1.

Support device 1 may also be used on persons suffering from burns. One or more support devices 1 may be fitted to a limb, for example, so as to lift a burnt area of skin off the surface on which it would otherwise lie. This would provide the wearer of the device with freedom of movement which present methods (referred to earlier) do not provide for.

Figure 1:
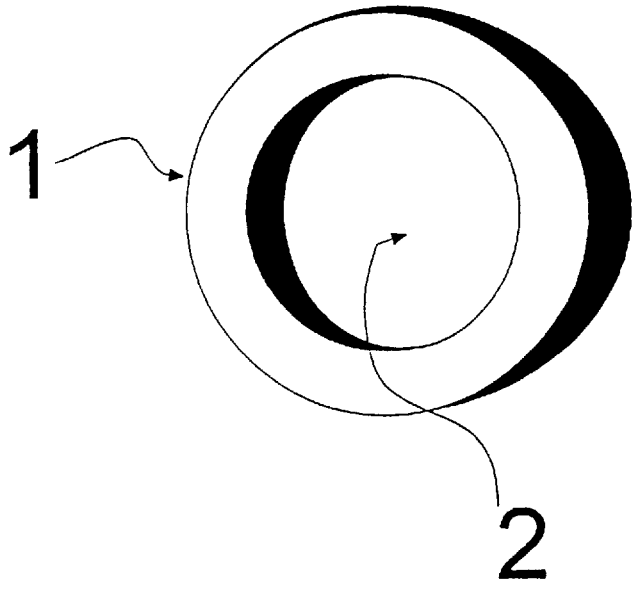
FIG. 1 is a schematic representation of the support device.
Figure 2:
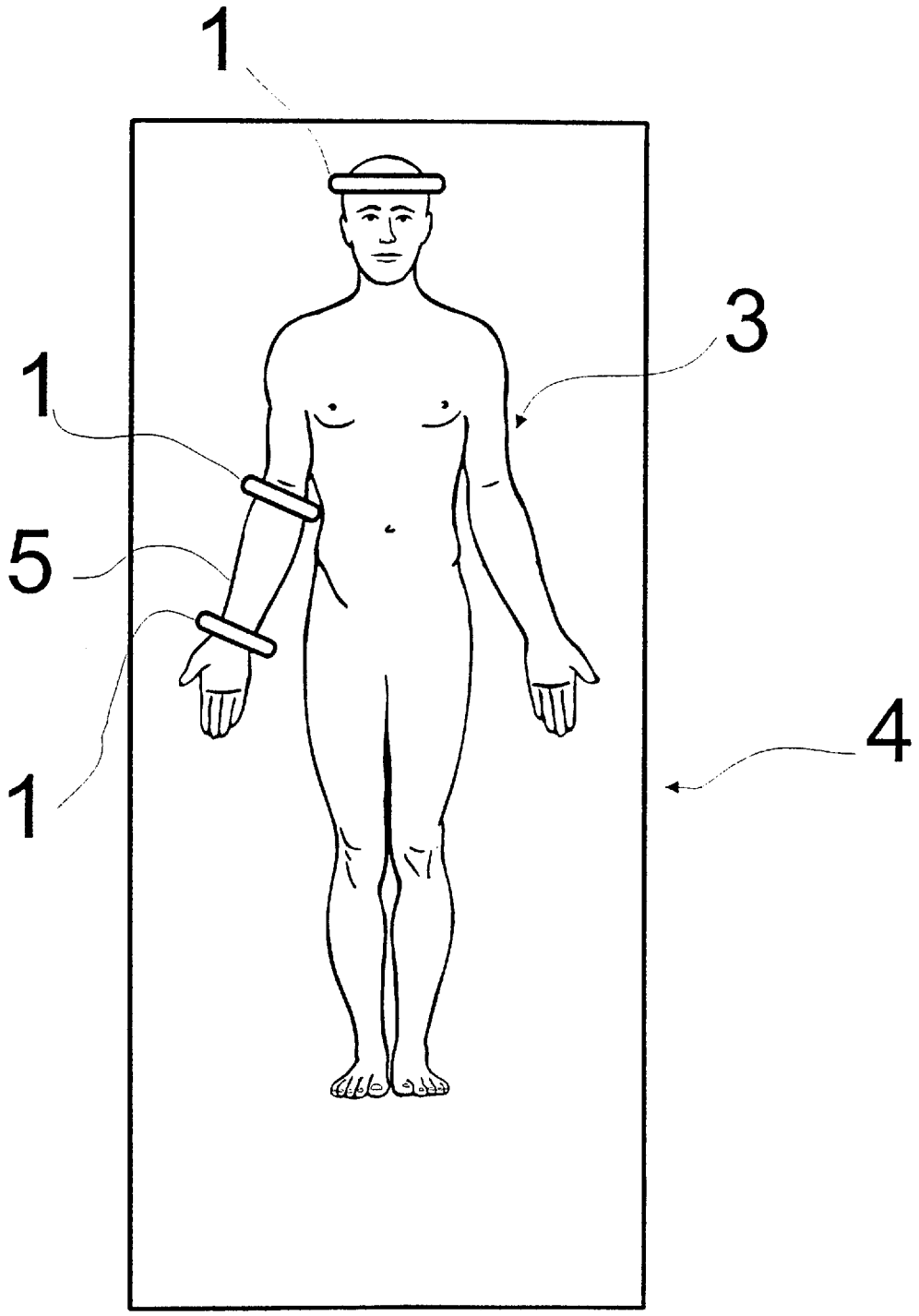
FIG. 2 is a plan view of a person lying on a bed, and wearing support devices according to the invention.
Figure 3:
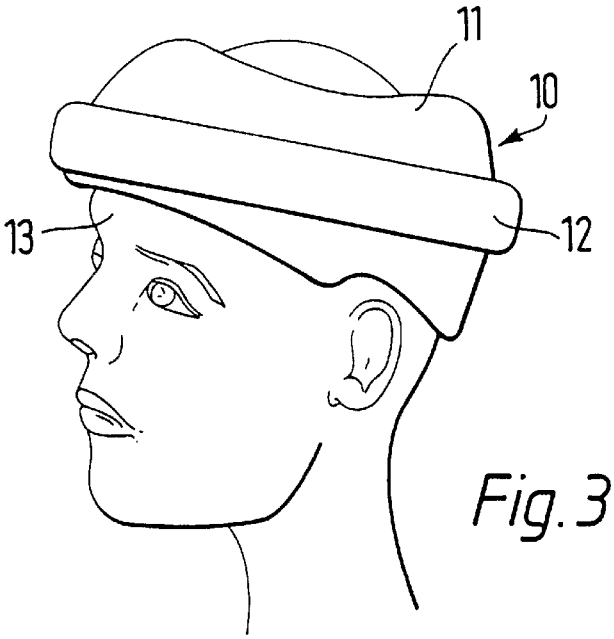
FIG. 3 is a schematic representation of another embodiment of a support device according to the invention being worn by a person.
Figure 4:
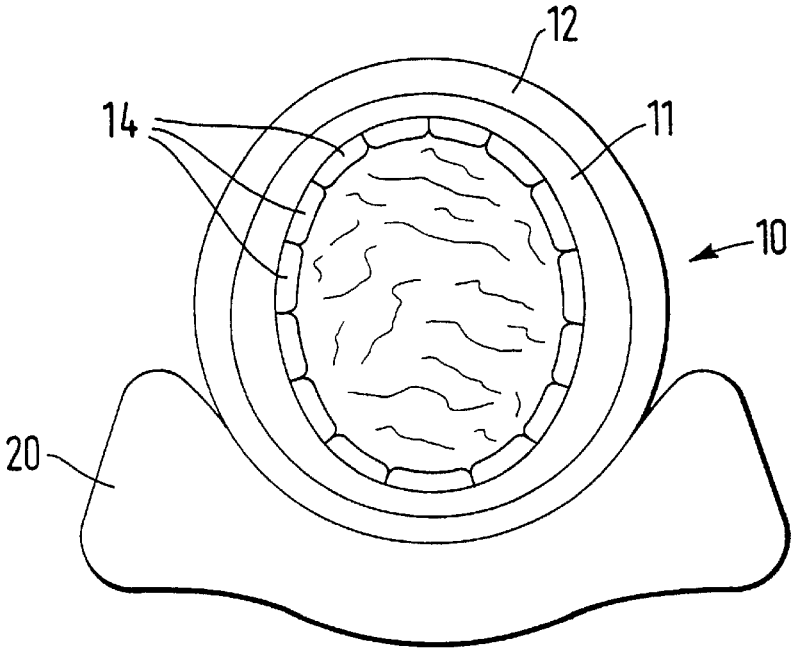
FIG. 4 is a top view of the support device shown in FIG. 3.

FIG. 2 shows a person 3 lying on a bed 4, and wearing three support devices 1.

Support device 1 worn around the head of person 3 shows how the device is used either to alleviate discomfort caused by stitches/scarring as a result of a face-lift operation, or to prevent ageing. The support device 1 is fitted to a part of the head which has not been operated on during the face-lift. When the person then lies down, the device supports the head so that the stitched/scarred area on the neck and behind the ears is lifted clear of the surface of the bed 4, upon which the person lies. Furthermore, the device may be so shaped and dimensioned that when fitted to a person's head, and the person is lying down, the head is supported and maintained, with respect to the rest of the person's body, in essentially the same position that the head would be in, if the person were standing up-right. This reduces to a minimum, the amount of stretching of the stitched/scarred areas.

As a device to prevent ageing, when fitted to a person's head, and the person is in a lying down position the support device 1 supports the head, with respect to the rest of the person's body, in essentially the same position that the head would be if the person were standing upright. The support device 1 also ensures that the face does not come into contact with the surface of the bed 4, which might cause wrinkling of the skin.

FIG. 2 also shows two support devices 1 fitted to the person's arm. This allows how the support device might be used on a person suffering from burns to the forearm 5. With the two support devices 1 fitted to the person's forearm 5 on either side of a burnt area, the said burnt area is lifted off the surface of the bed 4, on which it would otherwise lie. However, the person is still has freedom of movement of his/her arm, which is not the case when the limb is held off the surface by a sling, or other known devices.

Figure 5:
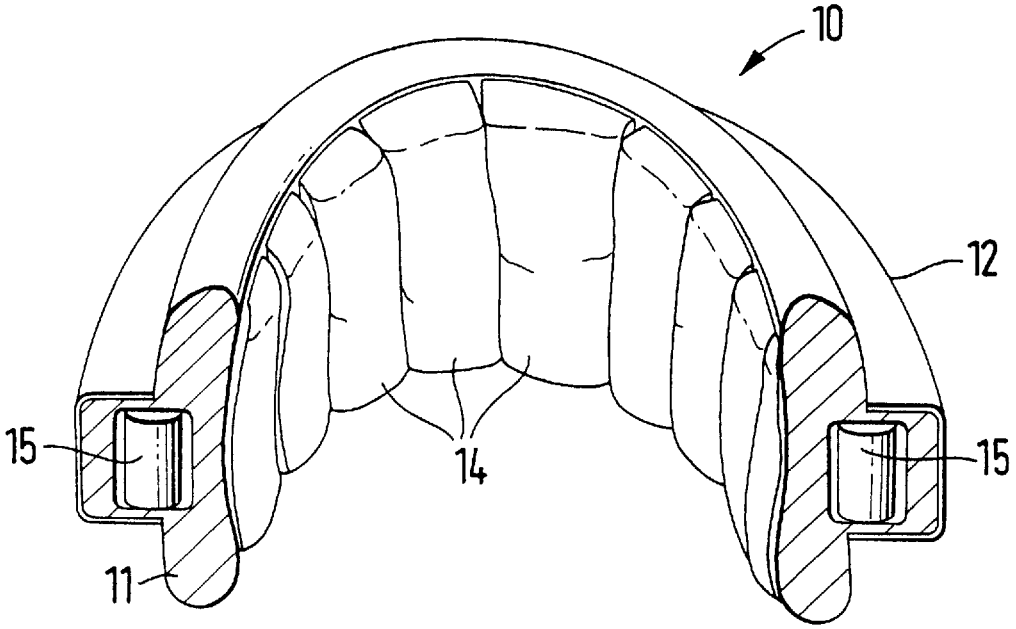
FIG. 5 is a sectional view of the support device shown in FIG. 3.
Figure 6:
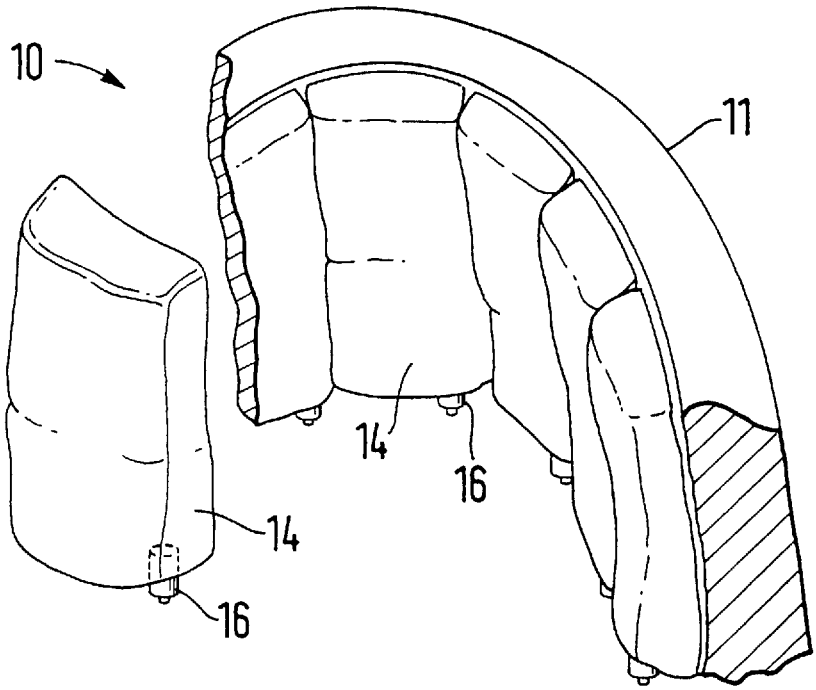
FIG. 6 is a exploded view of the support device shown in FIG. 5.
Figure 7:
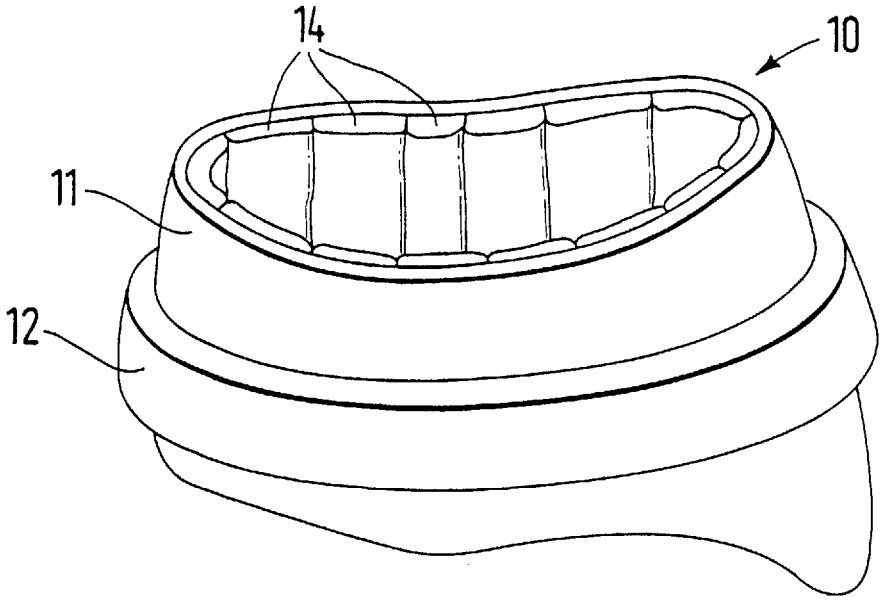
FIG. 7 is a side perspective view of the support device shown in FIG. 5.
Figure 8:
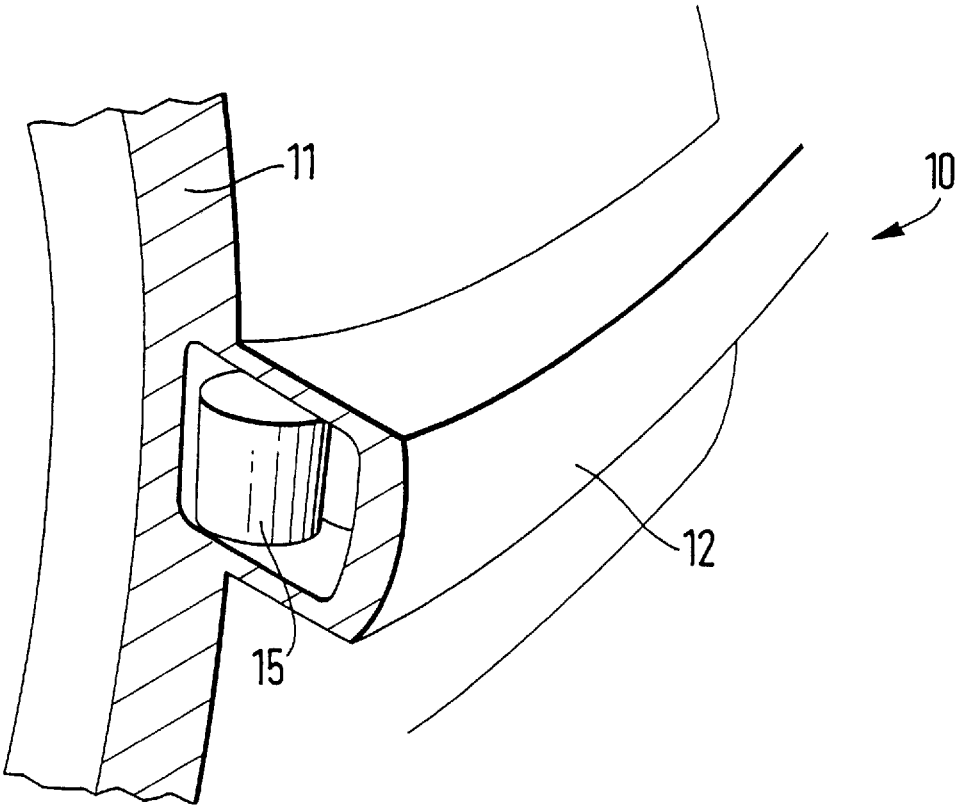
FIG. 8 is a partial sectional view of a part of the support device shown in FIG. 5.

Referring now to FIGS. 3 to 8, a support device 10 is shown, the device comprising an inner ring 1 which is adapted to fit snugly on the wearer's 13 head and an outer ring 12. The outer ring 12 is mounted on inner ring 11 so that the outer ring 12 can rotate with respect to the inner ring 11, whilst the inner ring remains substantially fixed in place on the wearer's head 13. Rollers 15, as shown in FIGS. 5 and 8, provide for rotation of the outer ring 13 with respect to the inner ring 11.

Outer ring 12 is made from a relatively hard material such as a plastics material, whilst inner ring 11 is also made from a relatively hard material such as a plastics material, but on the inner surface of inner ring 11, there is mounted a plurality of inflatable pockets 14, having valves 16 which permit inflation of the pockets 14. The resilient nature of the inflatable pockets 14 permits the inner ring 11 to fit snugly on to the wearer's head, and by inflating pockets 14 by differing amounts, the device can be adapted to fit heads of different size and shape. Of course, inflatable pockets 14 could be replaced by another resilient member such as a foam material.

The embodiment shown in FIGS. 3 to 8 is particularly useful, since it allows the part of the body to which it is filled to move without tending to move the support device with respect to that part of the body. This means that the support device is less likely to come off the wearer.

Figure 9:
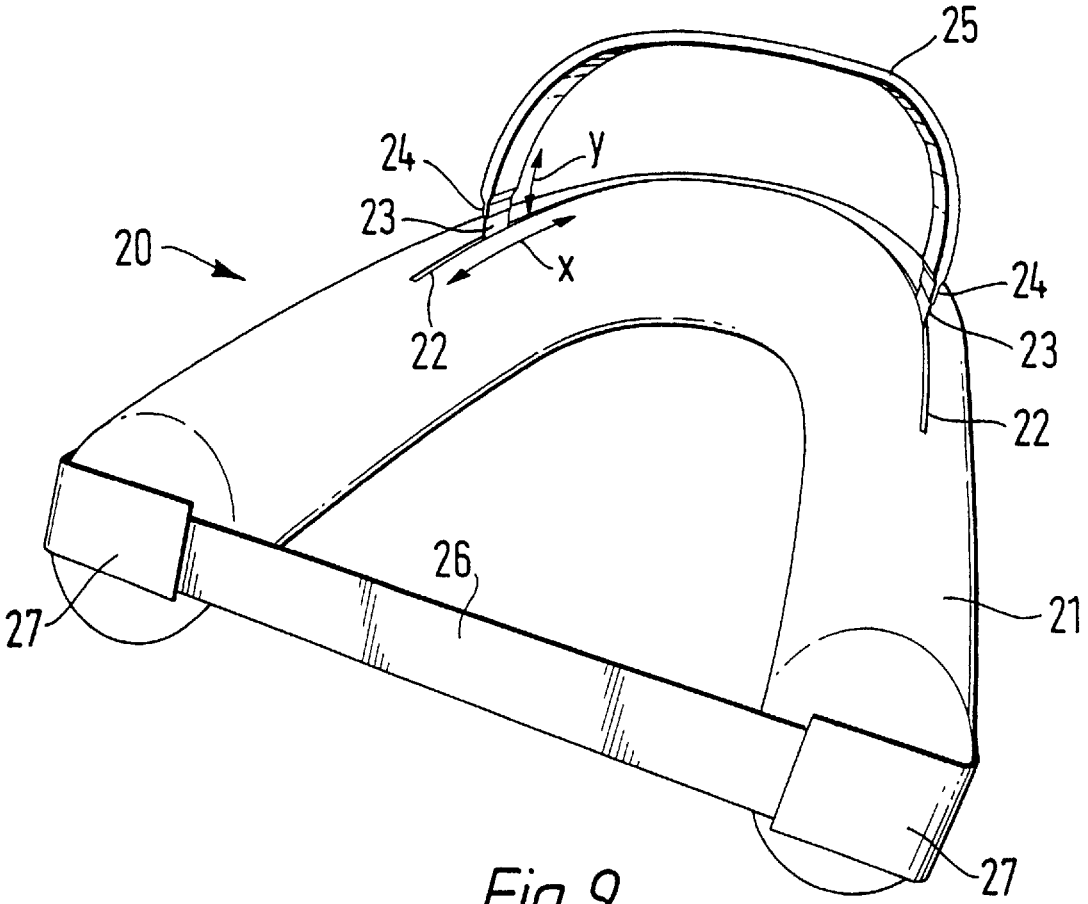
FIG. 9 is a schematic representation of a further embodiment of a support device according to the invention.
Figure 10:
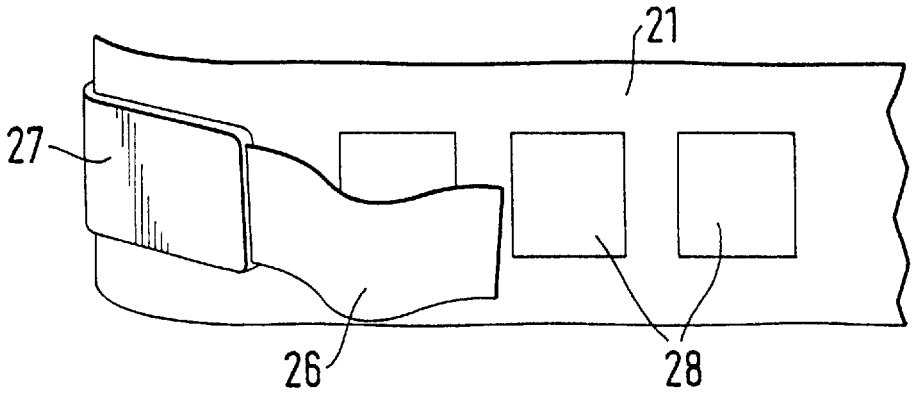
FIG. 10 is a side view of a part of the device shown in FIG. 9.
Figure 11:
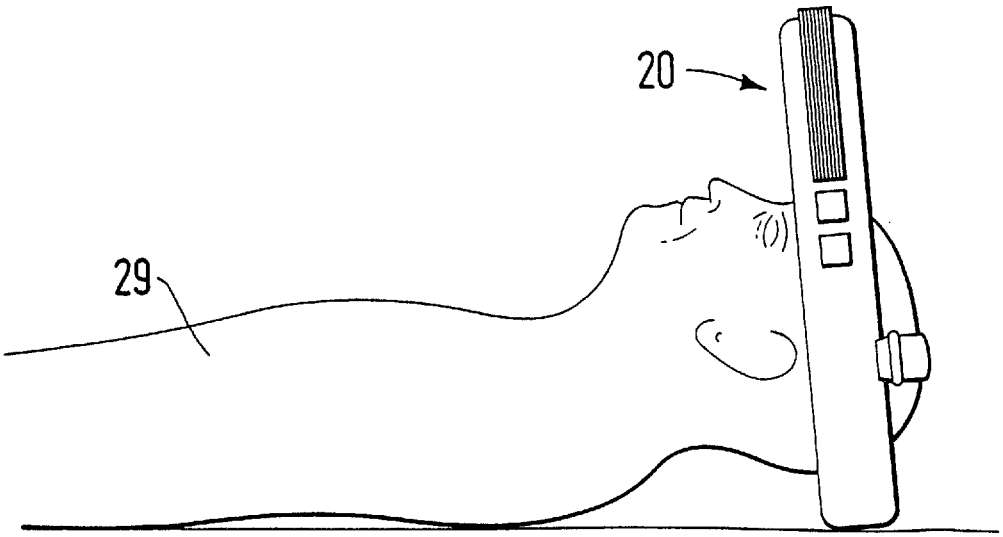
FIG. 11 is a side view of the device shown in FIG. 9 being worn by a person.

A further embodiment of a support device according to the invention is shown in FIGS. 9 to 11. The device 20 comprises a length of resilient material 21, such as foam or sponge, which is in the shape of a U, the ends of the U being joined by a length of elastic material 26. The length of elastic material 26 is slidably mounted in retaining members 27, and the ends of material 26 are provided with a section of Velcro ® which co-operates with one of the sections of Velcro ® 28 mounted on the sides of resilient material 21, best shown FIG. 10. By changing the section 28 of Velcro ® to which the Velcro ® section mounted on elastic material 26 is attached, the distance between the free ends of the U shape can be varied, so as to enable device 20 to be used on people having heads of different sizes.

A slider strap 25 is mounted in a groove 22 in material 21 by means of a slider 23. The slider 23 can be moved forwards or backwards in the direction indicated by arrow "x" to adjust the position of the device 20 on the wearer 29. Also, the strap 25 can be moved upwards and downwards in the direction "y" by virtue of strap 25 being telescopically mounted on slider 23 by means of mounting 24. The telescopic mounting of strap 25 enables the device 20 to be positioned on the head of the wearer in such a manner that the device 20 will not move down the head towards the stitched or scarred region around the cars caused during a face-lift operation.

As can be seen from FIG. 11, the ends of the U shaped device 20 extend forwardly of the head. The effect of this is to limit the angle through which the head can rotate to 180° degrees.

We claim:

1. A device for supporting a person's head above a resting surface while permitting movement of said head comprising:

a ring member securable to said head and having a support portion along an inner surface extending around at least the back and sides of said head, said support portion shaped and dimensioned to lift said head clear of said resting surface when said outer surface rests upon said resting surface, said support portion being U-shaped and having two ends and a connecting means joining said ends; and a slider strap near the closed portion of said U-shape to adjust the position of said support portion on said person's head.

2. A device according to claim 1, wherein the material from which said support portion is made is adapted to the size and weight of said head on which said ring is worn.

3. A device according to claim 1, wherein the dimensions of said support portion are adapted to the size and weight of said head on which said ring is worn.

4. A device according to claim 1, wherein the size of said ring is adjustable.

5. A device according to claim 1, wherein at least a part of said support portion comprises a resilient portion.

6. A device according to claim 5, wherein said resilient portion is formed from an inflatable member.

7. A device according to claim 1, wherein said connecting means is strap.

8. A device according to claim 7, wherein said strap is resilient.

9. A device according to claim 1, wherein at least a part of said support portion is covered with a layer of material.

10. A device according to claim 9, wherein said covering material is chosen from a group of materials comprising a washable material, a sterilizable material, and a waterproof material.

11. A device according to claim 1, wherein at least one part of said support portion is flat so as to limit the extent to which said head can move.

12. A device according to claim 1, wherein said support portion comprises inner and outer ring members moveable with respect to each other, said inner ring member comprising at least one inflatable member.

13. A device according to claim 12, further comprising a plurality of discrete inflatable members.

14. A device according to claim 12, wherein said outer ring member is made from a relatively hard material, and said inner ring member is rotatably mounted on said outer ring member by a mounting means.

15. A device according to claim 14, wherein said mounting means further comprises a plurality of rollers.

16. A device according to claim 14, wherein said inner ring member comprises a shell formed from a relatively hard plastics material, there being at least one inflatable member mounted within said shell.

17. A device according to claim 16, wherein said mounting means comprises a groove in which said outer ring member sits, said groove provided in said shell.

18. A device according to claim 17, wherein a friction reducing material is provided to control movement of said inner and outer ring members.

19. A device according to claim 1, wherein said support portion is so shaped and dimensioned that when said device is worn on said head, and said person is lying down, said head is supported and maintained, with respect to the rest of said person's body, in essentially the same position that said head would be in if said person were standing upright.

* * * * *